United States Patent [19]

Noé et al.

[11] Patent Number: 4,602,408

[45] Date of Patent: Jul. 29, 1986

[54] ROLL-STAND ROLL WITH HYDRAULICALLY CHANGEABLE CONTOUR

[75] Inventors: Andreas Noé, Mühlberg; Rolf Noé, Berlin-Charlottenburg, both of Fed. Rep. of Germany

[73] Assignee: BWG Bergwerk- und Walzwerk-Maschinenbau GmbH, Duisberg, Fed. Rep. of Germany

[21] Appl. No.: 672,573

[22] Filed: Nov. 16, 1984

[30] Foreign Application Priority Data

Nov. 22, 1983 [DE] Fed. Rep. of Germany ..... 3342054

[51] Int. Cl.[4] ..... B21B 31/32; B60B 9/22

[52] U.S. Cl. ..... 29/113 AD; 29/116 AD

[58] Field of Search ..... 29/116 R, 116 AD, 113 AD, 29/113 R, 110; 100/167 B, 93 RP; 277/177, 170, 171, 172

[56] References Cited

U.S. PATENT DOCUMENTS

| | | | |
|---|---|---|---|
| 242,058 | 5/1881 | Schürmann | 29/116 R |
| 3,676,909 | 7/1972 | Tuomalla | 29/116 AD X |
| 4,447,940 | 5/1984 | Appenzeller et al. | 29/116 AD |

FOREIGN PATENT DOCUMENTS

| | | | |
|---|---|---|---|
| 1120825 | 2/1956 | Fed. Rep. of Germany | 277/170 |

*Primary Examiner*—Howard N. Goldberg
*Assistant Examiner*—Timothy V. Eley
*Attorney, Agent, or Firm*—Karl F. Ross; Herbert Dubno

[57] ABSTRACT

A roll for a hot- or cold-rolling stand has a core having an outer surface centered on an axis and a pair of axially opposite ends and respective conduits extending through the core and opening adjacent the ends thereof. A sleeve having an outer surface, axially opposite ends, and an inner surface centered on the axis coaxially surrounds the core. One of the surfaces has a central portion projecting radially toward and engaging the other surface between the ends in all-around annular contact. Respective elastic and annular seals engage radially between the ends of the rolls, that is each seal engages betwen one end of the sleeve and the corresponding end of the core. These seals define respective annular compartments at the ends, between the roll surfaces, and subdivided axially from each other by the central portion of the one surface. Each conduit opens into a respective one of the compartments. The compartments can be pressurized via the respective conduits to change the shape of the outer surface of the sleeve at least at the compartments.

9 Claims, 5 Drawing Figures

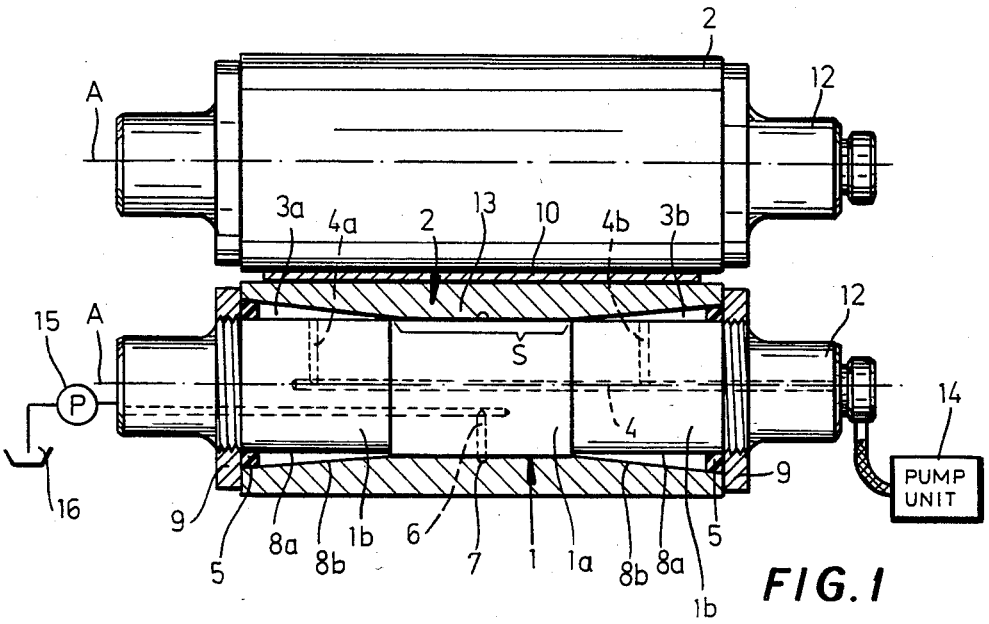
FIG. 1
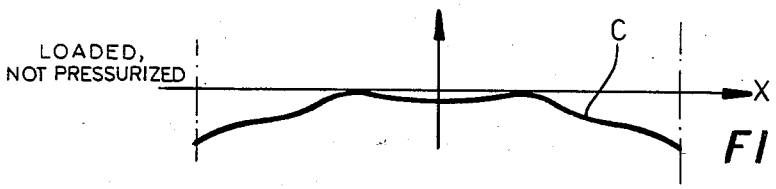
FIG. 2
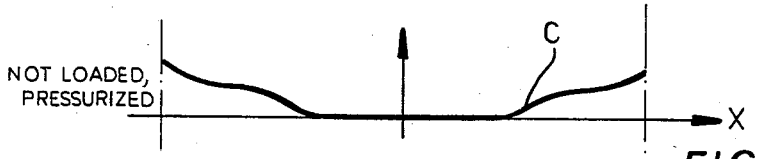
FIG. 3
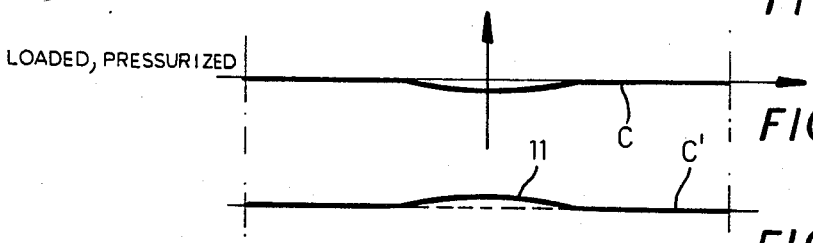
FIG. 4
FIG. 5

ROLL-STAND ROLL WITH HYDRAULICALLY CHANGEABLE CONTOUR

FIELD OF THE INVENTION

The present invention relates to a roll for a hot- or cold-rolling stand. More particularly this invention concerns a hydraulically swellable roll of the type used to roll out sheet metal.

BACKGROUND OF THE INVENTION

It is known in hot- and cold-rolling operations to use a roll formed by a core and a sleeve together defining a chamber that can be pressurized to radially swell the sleeve. In this manner the standard bending of the working rolls can be compensated out, and the hydraulic pressure can be adjusted for different rolling pressures to produce a fairly flat workpiece, as the rolls will be more or less parallel at their confronting surfaces at the rolling nip.

In a standard such arrangement the roll core is dumbbell shaped and is fitted within a cylindrically tubular sleeve. The enlarged ends of the core are radially shrunk by cooling and the sleeve is radially expanded by heating to fit the assembly together, so that when the two parts become the same temperature they are a tight fit. Such a procedure normally axially tensions the sleeve, as it shrinks radially into tight contact with the core ends before it has finished its substantially greater axial shrinking. This of course also axially compresses the core. As a result the roll has a tendency to bend, and this tendency increases when the swelling chamber is pressurized.

Another disadvantage is that a roll of this construction is subjected to substantially more torsion than solid rolls. Such a roll is normally driven from one end of the core only. The reduced diameter central portion of the core cannot transmit the torque from one end to the other without distorting, and the sleeve transmits little torque. The resultant torsional deformation further bends the roll, typically away from the other roll. In hot-rolling operations this torsional deformation is so great that it has a noticeable effect on the workpiece shape, creating the known saber effect, that is the roll edges will be lightly curved but parallel lines, making the strip workpiece difficult to guide in the rolling line.

OBJECTS OF THE INVENTION

It is therefore an object of the present invention to provide an improved roll for a hot- or cold-rolling stand.

Another object is the provision of such a roll for a hot- or cold-rolling stand which overcomes the above-given disadvantages, that is whose shape can be adjusted hydraulically, but that remains straight.

A further object is to provide a swellable roll that does not have the above-described radial tensions caused by the thermal fitting operation, and that does not torsionally distort.

SUMMARY OF THE INVENTION

A roll for a hot- or cold-rolling stand according to the invention has a core having an outer surface centered on an axis and a pair of axially opposite ends and respective conduits extending through the core and opening adjacent the ends thereof. A sleeve having an outer surface, axially opposite ends, and an inner surface centered on the axis coaxially surrounds the core. One of the surfaces has a central portion projecting radially toward and engaging the other surface between the ends in all-around annular contact. Respective elastic and annular seals engage radially between the ends of the rolls, that is each seal engages between one end of the sleeve and the corresponding end of the core. These seals define respective annular compartments at the ends, between the roll surfaces, and subdivided axially from each other by the central portion of the one surface. Each conduit opens into a respective one of the compartments. The compartments can be pressurized via the respective conduits to change the shape of the outer surface of the sleeve at least at the compartments.

In this construction there will be no axial stresses created in the sleeve and core when they are thermally fitted together, as at the only region where there is radial contact capable of transmitting axial force the two elements engage each other continuously. The seals do not transmit axial force between the ends of the core and sleeve.

With this system roll bending is compensated for by swelling the roll outer surface at its ends rather than at its middle. Hence the roll is appropriately contoured in that it has, when unloaded and pressurized, a contour (here defined as the line formed by that axially extending linear portion of the roll surface that defines the respective half of the nip) which is complementary to the contour it would have if of cylindrical shape and loaded. Thus the roll has when pressurized and loaded a generally cylindrical shape, although it is within the scope of this invention to crown the roll slightly at the central portion to make the height of the nip almost perfectly uniform.

According to the invention the one surface is the outer surface of the sleeve and the all-around contact is surface contact. In addition the sleeve is formed with a central conduit in the core and opening radially outward thereon at the central portion. Thus a lubricant can be forced under pressure through the central conduit to loosen the sleeve on the core.

The core surface is normally cut back to either axial side of the central portion. In addition the inner surface of the sleeve is cylindrical and the compartments are of generally triangular section. In this case the roll also has respective holding rings secured on the core ends and projecting radially inward of the inner core surface at the core ends. The seals engage axially oppositely outward against the holding rings.

DESCRIPTION OF THE DRAWING

The above and other features and advantages will become more readily apparent from the following, reference being made to the accompanying drawing in which:

FIG. 1 is an end view partly in axial vertical section through a roll pair according to this invention;

FIGS. 2, 3, and 4 are exaggerated illustrations of the roll contour at the nip according to the invention; and FIG. 5 is an illustration of the roll contour of a variation on the instant invention.

SPECIFIC DESCRIPTION

As seen in FIG. 1 rolls according to this invention are centered on parallel axes A and vertically flank a workpiece 10. Each roll basically comprises a core 1 of solid shape that is mounted in end stubs 12 in not illustrated journal blocks of the roll-stand frame, and a sleeve 2 also centered on the axis.

The core 1 has a large-diameter central portion 1*a* of cylindrical shape and having an axial length S that flatly engages the cylindrical central portion 13 of the sleeve 2 in all-around cylindrical surface contact. The core 1 has a pair of end regions 1*b* that are both of cylindrical shape but of smaller diameter than the central portion 1*a* and that each have a radially outwardly directed outer surface 8*a*. The sleeve 2 is flared oppositely axially outward and has radially inwardly directed frustoconical surfaces 8*b* radially generally confronting the surfaces 8*a*.

The outer ends of the core 1 are threaded to rings 9 against which elastic seal rings 5 bear axially. Thus each surface 8*a* defines with the respective surface 8*b* and the respective ring 5 a respective triangular-section compartment 3*a* or 3*b*. The core 1 is formed with one or two axially extending passages 4 opening via respective radial passages 4*a* and 4*b* into the compartments 3*a* and 3*b*. A high-pressure hydraulic pump unit 14 is connected to this conduit system 4, 4*a*, 4*b* to pressurize the compartments 3*a* and 3*b* and thereby radially deform the sleeve 2.

The system is assembled by heating the sleeve 2 and/or cooling the core 1 and axially fitting the two together. The central portions 1*a* and 13 are of the same outer and inner diameters, respectively, so that when the core 1 and sleeve 2 are at the same temperature they engage each other very tightly. Then the seal rings 5 are installed and the rings 9 screwed into place.

The core 1 is also formed with an axial and radial conduit 6 that opens radially in the middle of the central region 1*a* at a radially inwardly open central groove 7 of the sleeve 7. A pump 15 can force oil from a sump 16 through the conduit 6 to form a lubricant film between the portions 1*a* and 13 and allow the sleeve 2 to be slipped axially off the core 1 if necessary.

As shown in FIG. 2 when the roll is loaded but not pressurized it has the contour C which is raised in the central portion 1*a* and low at the compartments 3*a* and 3*b*. When not loaded but pressurized the roll has the contour C shown in FIG. 3, so that when loaded and pressurized the contour C which is shown in FIG. 4 and which is the composite of the shapes shown in FIGS. 2 and 3. This is relatively flat, but with a slight central bump that can be compensated out by providing on the outer surface of the roll a radially outwardly projecting annular bump 11 as seen at C' in FIG. 5.

I claim:

1. A roll for a hot- or cold-rolling stand, the roll comprising:

a core having an outer surface centered on an axis and a pair of axially opposite ends;

respective conduits extending through the core and opening adjacent the ends thereof;

a sleeve having an outer surface, axially opposite ends, and an inner surface centered on the axis and coaxially surrounding the core, one of the surfaces having a central portion projecting radially toward and engaging the other surface between the ends in all-around annular contact;

respective elastic and annular seals compressed radially between the ends of the sleeve and the respective ends of the core and defining respective annular compartments at the ends, between the respective inner and outer surfaces, and subdivided axially from each other by the central portion of the one surface, each conduit opening into a respective one of the compartments; and means for pressurizing the compartments via the respective conduits and thereby changing the shape of the outer surface of the sleeve at least at the compartments.

2. The roll-stand roll defined in claim 1 wherein the one surface is the outer surface of the sleeve and the all-around contact is surface contact, the sleeve being shrunk onto the core.

3. The roll-stand roll defined in claim 2, further comprising:

a central conduit in the core and opening radially outward thereon at the central portion; and means for forcing a lubricant under pressure through the central conduit and thereby loosening the sleeve on the core.

4. The roll-stand roll defined in claim 1 wherein the one surface is cut back to either side of the central portion.

5. The roll-stand roll defined in claim 4 wherein the inner surface of the sleeve is cylindrical and the compartments are of generally triangular section.

6. The roll-stand roll defined in claim 4, further comprising:

respective holding rings secured on the core ends and projecting radially inward of the inner core surface at the core ends, the seals being engaged axially oppositely outward against the holding rings.

7.The roll-stand roll defined in claim 1 wherein the outer sleeve surface is contoured for average rolling pressure.

8. The roll-stand roll defined in claim 1 wherein the core is cylindrically stepped.

9. The roll-stand roll defined in claim 1 wherein the sleeve is axially oppositely frustoconically flared at its ends.

* * * * *